United States Patent [19]

Matsuda

[11] 3,974,549

[45] Aug. 17, 1976

[54] WARP-KNITTED TAPE FOR SLIDE FASTENER

[75] Inventor: Yoshio Matsuda, Nyuzen, Japan

[73] Assignee: Yoshida Kogyo Kabushiki Kaisha, Japan

[22] Filed: Nov. 26, 1974

[21] Appl. No.: 527,223

[30] Foreign Application Priority Data

Nov. 30, 1973 Japan ..... 48-138596[U]

[52] U.S. Cl. ..... 24/205.1 C; 66/195; 24/205.16 C

[51] Int. Cl.[2] ..... A44B 19/00

[58] Field of Search ..... 24/205.16, 205.1 C, 24/205; 66/190–195

[56] References Cited

UNITED STATES PATENTS 3,685,474 8/1972 Frohlich et al. ..... 66/195 UX 3,820,202 6/1974 Takamatcu et al. ..... 66/195

3,849,842 11/1974 Yoshida ..... 66/195

*Primary Examiner*—Ronald Feldbaum

*Attorney, Agent, or Firm*—Bucknam and Archer

[57] ABSTRACT

A warp-knit tape structure is disclosed for use as a carrier tape for mounting thereon a row of fastener elements. The carrier tape has a web portion and adjoining marginal edge portion extending one longitudinal edge of the tape, said edge portion having a relatively wide interwale groove for the passage of a sewing machine needle and a plurality of wales adjacent to said interwale groove held closely together to provide a reinforced region disposed for sliding contact with a slider of the slide fastener.

5 Claims, 2 Drawing Figures

WARP-KNITTED TAPE FOR SLIDE FASTENER

BACKGROUND OF THE INVENTION

This invention relates to a carrier tape for slide fastener and has particular reference to a warp-knitted tape for mounting thereon a row of interlocking fastener elements.

Attempts have heretofore been made to provide warp-knitted fastener tapes capable of mounting rows of fastener elements securely in position against displacement, for which purpose the marginal edge portion of the tape has been strengthened with rather complicated knit patterns. This has led to the drawback that when sewing the fastener elements to the tape, the sewing needle tends to slip out of the correct line of path on account of resistance of too densely knitted threads, resulting in misaligned rows of fastener elements on the tape. Furthermore, the knit structure of the borderline between the web and the edge portion has been rendered somewhat irregular and frail so that the tape was liable to wear at the region which is disposed in frictional contact with a slider.

SUMMARY OF THE INVENTION

With the above noted drawback of the prior art in view, it is an object of the invention to provide an improved warp-knitted carrier tape for slide fastener which incorporates structural features to permit a sewing needle to follow a correct line of path along a longitudinal marginal edge of the tape, thereby securing a row of fastener elements into properly aligned position on the tape.

Another object of the invention is to provide an improved warp-knitted carrier tape having sufficient resistance to wear in frictional contact with a slider during the opening and closing operation of the fastener.

Briefly stated, the knitted carrier tape according to the invention essentially comprises a web portion and a marginal edge portion extending longitudinally thereof, said web portion consisting of chain stitches which form longitudinally extending wales, tricot stitches interknitted therewith and extending across at least two adjacent wales, first groups of transversely extending lapping threads each laid over and across a plurality of wales and arranged to wrap around a location where said chain stitches and said tricot stitches are interknitted in each course, and said marginal edge portion consisting of a first or innermost wale and a second wale adjacent thereto, said first and second wales being spaced apart to provide an interwale groove greater in width than the rest of wales in the web portion and, second groups of transversely extending lapping threads extending over and across said first wale and adjacent wales and formed of thicker yarns, said adjacent wales being held together to provide interwale grooves therebetween narrower than the remaining grooves in the web portion.

The invention itself, together with the further objects and advantages thereof, will appear more clear from the following detailed description taken in connection with the accompanying drawings illustrating by way of example a preferred embodiment which the invention may assume in practice.

BRIEF DESCRIPTION OF THE ACCOMPANYING DRAWINGS

FIG. 1 diagrammatically illustrates the construction of a warp-knitted carrier tape according to the invention; and FIG. 2 is a transverse cross-sectional view of the same with a row of fastener elements mounted thereon together with a slider.

DESCRIPTION OF THE PREFERRED EMBODIMENTS

Figure 1:
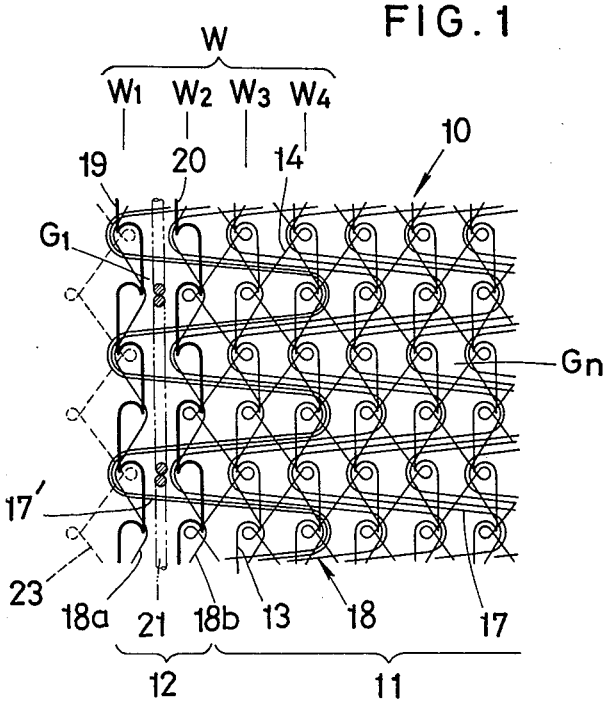

Referring now to FIG. 1, there is shown a carrier tape of a warp-knit structure for slide fasteners, which tape generally designated by the reference numeral 10 comprises a web portion 11 and a marginal edge portion 12 extending longitudinally thereof. The web portion 11 is constructed with chain stitches 13, which form longitudinally extending wales W, and tricot stitches 14 or similar tricot stitches that run across two adjacent wales such as for example an open-pillar stitch. Laid in this foundation structure are transversely extending lapping threads 17 each laid over and across a predetermined number of wales W, e.g. every four wales as in the illustrated embodiment and arranged to wrap around a location where chain stitches 13 and tricot stitches 14 are inter-knitted in each course. There are also provided warp threads 18 which are arranged to extend meanderingly along the wales W in a direction to close the open laps of the respective wales W.

The marginal edge portion 12 of the tape 10 to which the fastener elements E (FIG. 2) are to be attached is comprised of chain stitches 19 and 20 forming a first wale $W_1$ and a second wale $W_2$, respectively. The first wale $W_1$ located at an extreme edge or innermost of the tape and the second wale $W_2$ lying adjacent thereto are spaced apart to provide therebetween an interwale groove $G_1$ greater in width than the grooves $G_n$ in the web portion 11. By reason of the provision of this wider interwale groove $G_1$, a sewing machine needle (not shown) can run straight along a correct line of path, without slippage, to produce stitchings 21 that secure the fastener elements E into properly aligned position on the tape 10. The chain stitches 19 and 20 in the marginal edge portion 12 are preferably formed of relatively thick yarns. It will be seen that the first wale $W_1$, second wale $W_2$, third wale $W_3$ and fourth wale $W_4$ are interconnected by transverse lapping threads 17' comprised of threads thicker and stronger than lapping threads 17 in the web portion 11 or two or more of the latter threads bundled together.

Under the influence of the lapping action of the transverse lapping thread 17' and the tension of the tricot stitches 14, the wales $W_2$, $W_3$ and $W_4$ are held closely together so that the interwale grooves $G_2$ and $G_3$ therebetween are narrowed as compared with the grooves G in the web portion 11. This process is facilitated by the absence of tricot stitches at the region of the wales $W_1$ and $W_2$. This can provide a relatively rigid tape portion 22 which is defined by the three wales $W_2$, $W_3$ and $W_4$ pulled together and which therefore exhibits high resistance to wear when subjected to frictional contact with a reciprocating slider.

Along the wales $W_1$ and $W_2$ of the marginal edge portion 12 are also arranged warp threads **18*a* and 18*b* similar to those interknitted in the web portion 11** of the tape.

Designated at 23 is a connection thread adapted to connect a plurality of unit tapes widthwise that are produced in parallel, which connection thread may be removed to separate the tapes to individual product lengths in a manner well known in the art. The connecting thread 23 urges the first wale $W_1$ towards the left-hand side as viewed in the drawings and at the same time, the wale $W_1$ is pulled towards the right by the lapping threads 17', the two tensions in opposite directions cancelling each other out to retain the wale $W_1$ in position away from the adjacent wale $W_2$. It will be noted that the wale $W_4$ adjacent the web portion 11 of the tape 10 is also retained in position against displacement by the tensions of both lapping threads 17 and 17' that work in opposite directions to cancel each other out.

The second wale $W_2$, due to the absence of tricot or other stitches spanning between this wale and the first wale $W_1$, is pulled towards the right-hand side of the drawings by the tensions of the lapping threads 17 and tricot stitches 14 and so urged together with the adjoining third wale $W_3$ to bias toward the fourth wale $W_4$, whereby the interwale groove $G_1$ between the first and second wales $W_1$, $W_2$ is rendered wider than the remaining grooves $G_n$ in the web portion 11.

Figure 2:
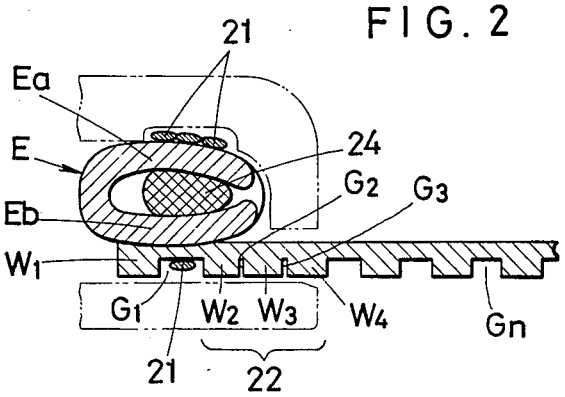

Referring now to FIG. 2, there is shown an example of the manner in which a row of fastener elements E is attached to the tape 10 provided in accordance with the invention. The fastener elements E with a core member 24 inserted therethrough are mounted on the marginal edge portion 12 of the tape 10 and secured in position by stitchings 21 that run through the legs E*a*,E*b*, of the fastener elements E. The sewing stitches 21 are securely anchored in the wide groove $G_1$ against lateral displacement, thereby ensuring high positional stability of the fastener elements E.

Having thus described the invention, it will be understood that various changes and modifications may be made in the specific form and construction herein advanced, without departing from the scope of the appended claims.

What is claimed is:

1. In a slide fastener having a warp-knitted tape, a row of fastener elements stitched to said tape along a marginal edge portion thereof, and a slider moveable along said fastener elements in sliding contact with a predetermined width portion of the tape, the improvement which comprises the tape having a web portion and a marginal edge portion extending longitudinally of the tape, said web portion including chain stitches that form wales, tricot stitches interknitted therewith and extending across at least two adjacent wales, and transverse lapping threads each laid over and across a plurality of wales and arranged to wrap around a location where said chain stitches and said tricot stitches are interknitted in each course, and said marginal edge portion including chain stitches that form a first wale and a group of adjacent wales, including a second wale and transverse lapping threads each laid over and across said first wale and adjacent wales, said first wale and second wale being in direct adjacency and spaced apart without any tricot stitch spanning therebetween to provide an interwale groove greater in width than each of the other wales in the web portion whereby said group of adjacent wales are held together to provide therebetween interwale grooves narrower than the remaining grooves in the web portion, said group of adjacent wales being disposed for sliding contact with the slider and defining said predetermined width portion of the tape, said fastener elements being stitched to the tape by stitches received in said greater width wale groove between said first and second wales.

2. The improvement according to claim 1 wherein said web portion and said marginal edge portion include warp threads adapted to extend along the wales in a direction to close open laps of the wales.

3. The improvement according to claim 1 wherein said chain stitches are thicker in the marginal edge portion than in the web portion.

4. The improvement according to claim 1 wherein said transverse lapping threads are thicker in the marginal edge portion than in the web portion.

5. The improvement according to claim 1 wherein the number of said transverse lapping threads is greater in the marginal edge portion than in the web portion.

* * * * *